US005805534A

United States Patent [19]

Terzian

[11] Patent Number: 5,805,534

[45] Date of Patent: Sep. 8, 1998

[54] POSITIONALLY CONSISTENT, BALANCED DIGITAL TIME DISPLAYS

[75] Inventor: Berj Terzian, Croton-on-Hudson, N.Y.

[73] Assignee: Equitime, Inc., Croton-on-Hudson, N.Y.

[21] Appl. No.: 635,604

[22] Filed: Apr. 22, 1996

[51] Int. Cl.[6] ..... G04C 19/00

[52] U.S. Cl. ..... 368/241; 368/239; 368/82

[58] Field of Search ..... 368/82–84, 224, 368/239–242

[56] References Cited

U.S. PATENT DOCUMENTS 4,264,966 4/1981 Terzian .
4,270,196 5/1981 Terzian ..... 368/82
4,271,497 6/1981 Terzian ..... 368/82
4,483,628 11/1984 Terzian .
4,627,737 12/1986 Nance et al. .
4,671,673 6/1987 Terzian ..... 368/82

*Primary Examiner*—Bernard Roskoski
*Attorney, Agent, or Firm*—Lucas & Just

[57] ABSTRACT

In a balanced digital time display and method which displays current hours with elapsed unit minutes to the right thereof and next hours with remaining unit minutes to the left thereof, complete positional consistency is achieved by displaying nonsignificant zero digits in the tens of minutes positions adjacent the elapsed and remaining unit minute digits during the initial and final nine minute intervals of an hour, the zero digits being visually smaller in size than the unit minute digits to signify that only the latter are providing significant minute time values during such intervals.

20 Claims, 2 Drawing Sheets

POSITIONALLY CONSISTENT, BALANCED DIGITAL TIME DISPLAYS

BACKGROUND OF THE INVENTION

1. Field of the Invention

This invention relates to digital time displays which are useful for general timekeeping. "General timekeeping", as used herein, means the usual timekeeping needs and practices of ordinary individuals occupied with their customary day-to-day activities, as contrasted from special time monitoring procedures such as stop time, split time, lap time and countdown sequences used in games, sporting events, scientific experiments, etc.

2. Description of the Prior Art

Balanced digital time displays useful for general timekeeping are disclosed in U.S. Pat. Nos. 4,264,966; 4,483,628 and 4,627,737, the disclosures of which are incorporated herein by reference. These patents show a central hours display, flanked on the right by elapsed minutes past the current hour and on the left by remaining minutes until the next hour, together with an optional display, below the hour, of seconds counting up and down during each minute, or up during elapsed minutes and down during remaining minutes.

U.S. Pat. No. 4,627,737 specifically teaches elimination of all nonsignificant zero minute digits, i.e., zeros are not shown in the tens of minute places during the nine minute periods before and after each hour, all significant minutes instead being displayed by single unit value digits. This patent further teaches that, for certain purposes and benefits, such single minute digits should be spaced away as far as possible on the right and the left of the central hours display.

3. Discovery of Problems in the Prior Art

Such spacing during the initial nine minute period after the commncement of a new hour is desirable from two standpoints. First, elapsed minute digits located farthest to the right of the central hour display during this period are consistent with the fact that the minute values are progressing upwardly and away from the new hour. Therefore, there is agreement between the spatial appearance of the display and what the viewer is experiencing relative to the numerical direction and progression of time. Also, the rightmost position is where the unit values of minutes will always be displayed throughout the subsequent twenty minute period, when all minutes will be seen in double digits defining the tens and unit minute values. Therefore, maintaining the single minute digits in the rightmost position during the initial nine minutes is also positionally and arithmetically consistent with the fact that that is where all unit values of minutes will be seen during the first half of each hour.

However, this is not the case in the second half hour, when remaining minutes are displayed to the left of the next hour. During the first twenty minutes of this period, all minute values also must be displayed with double digits ranging in value from twenty-nine to ten. The tens of minutes digits are spaced farthest to the left of the centrally located next hour display, and the unit values of minutes are in the intermediate position flanked by such tens of minutes on the left and by the hour on the right.

When, as taught in U.S. Pat. No. 4,627,737, subsequent single minute digits defining the remaining period of the second half hour (beginning with nine minutes) are shifted to the left, as far away as possible from the central hour display, an heretofore unappreciated dual contradiction occurs. First, although the minutes are indicating a time progression that is drawing closer to the next hour, the digits defining such minute values are shifted oppositely into a position that is spaced farthest from the displayed next hour. Thus, there is an anomaly between the spatial appearance of the display and the numerical direction and progression of time that the viewer is experiencing. Moreover, the remaining nine minutes are shifted from the intermediate position, where all previous unit values of minutes were displayed, to the leftmost position where only tens of minute values were previously displayed. This results in a positional and arithmetic contradiction, arising from the change in significance of the extreme left position from tens of minutes during the first twenty minutes of the second half hour to unit values of minutes for the remaining ten minutes of that half hour.

The Contradictions and anomalies described above are detrimental to the efficacy and appeal of the previously described displays.

SUMMARY OF THE INVENTION

The present invention avoids the foregoing problems by providing a display and a method in which nonsignificant zero minute digits are included during the initial and final nine minute intervals of a balanced digital time display, in a reduced size relationship to significant minute digits, so that the nonsignificant zeros are readily distinguishable visually from the significant minute digits. As a result, unit values of minutes during the initial and final nine minute intervals are maintained in the same positions as the unit minute values observed during the elapsed and remaining twenty minute intervals which respectively follow and precede such nine minute intervals. This renders the unit minute digits positionally and arithmetically consistent throughout the entire periods of the first and second half hours, thus eliminating uncertainties or confusion that were experienced by some viewers over the absence of nonsignificant zeros or the change in significance between the tens and unit remaining minute positions of the display described in U.S. Pat. No. 4,627,737.

Accordingly, in the displays of the present invention, visually smaller nonsignificant zero digits are included in the tens of minute positions adjacent the respective initial elapsed and final remaining nine minute digits. This innovation provides confirmation and reassurance to the viewer that such positions lack significant time information during those intervals, but with less emphasis and distraction from the simultaneously displayed unit minute digits which give the only significant minute values during those intervals. Preferably, the nonsignificant zero digits are half the overall size, for example, half the vertical height, of the unit minute digits and are placed in positions horizontally aligned with the elapsed and remaining nine unit minute digits to create generally upward and downward, or generally symmetrical, directions of view relative to the overall time information depicted in the display, which reinforces the viewer's understanding of the time being shown during such intervals.

Further details of the invention will be readily understood from the following description of preferred embodiments thereof taken in connection with the drawings.

BRIEF DESCRIPTION OF THE DRAWINGS

Referring to FIG. 1, there is illustrated digital display elements activated to display exactly 9 o'clock depicted by the central hour digit (10), tens of minutes digit (12), unit minutes digit (14), above hockey stick-shaped element (16) and zero seconds digit (18). At this point, the minute digits 12 and 14 are of equal full height size to prominently indicate the start of the current ninth hour, in contrast to the teaching of U.S. Pat. No. 4,627,737 which was to omit such digits.

Figure 2:
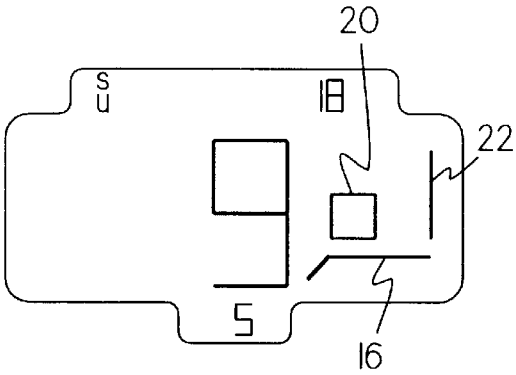
FIGS. 2 and 3 illustrate the FIG. 1 embodiment showing representative time displays within the first ten minutes of the ninth hour, in accordance with this invention.

Referring next to FIG. 2, there is illustrated the time of one minute and five seconds after the ninth hour. As is seen, the nonsignificant zero digit (20) in the tens of minutes place is one half in height and horizontally aligned with the lower half of the adjacent unit minute digit one (22). This confirms that there is no significant time value in the tens of minutes position and that the larger-sized adjacent minute digit (22) is the significant current time. Also, the upward direction of view involved in scanning the display from the central hour to the half-sized zero digit (20) to the taller full-sized minute digit (22), together with the corresponding upward left to right slant of the blade segment of the hockey stick-shaped element (16), gives visual reinforcement of the fact that the displayed time is in the increasing phase of the current hour.

Figure 3:
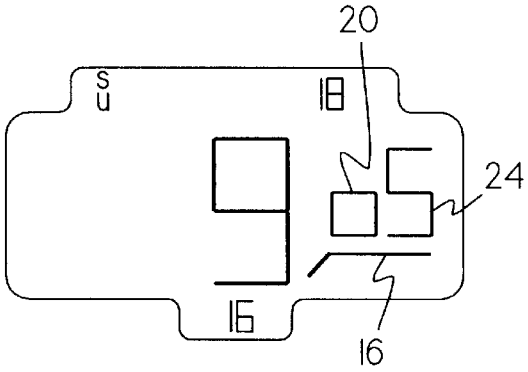

Referring next to FIG. 3, there is illustrated another moment within the first ten minutes of the ninth hour, in this case exactly five elapsed minutes and sixteen seconds. The same half-sized zero digit (20) relationship to the adjacent full-sized minute digit (24), in this case value five, together with the upwardly slanted hockey stickshaped blade segment, is seen as in FIG. 2.

Figure 4:
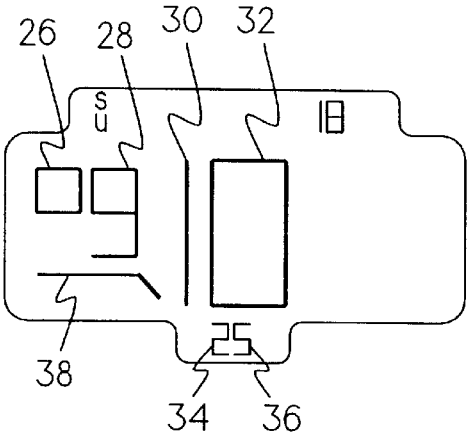
FIGS. 4–6 illustrate the FIG. 1 embodiment showing representative time displays during the last ten minutes of the ninth hour approaching the tenth hour, in accordance with this invention.

Referring next to FIG. 4, there is illustrated a representative time display within the last ten minutes of the current hour, as it approaches the tenth hour. Here a half-sized zero digit (26) is located in an upper vertical position horizontally aligned with the upper half of the trailing full-sized minute digit (28) having value nine, together with hour digits of value ten (30, 32), and seconds digits (34, 36) having value twenty five. Thus, the time displayed is exactly nine minutes and twenty five seconds before the tenth hour.

In contrast to the upward direction of view generated in the displays of FIGS. 2 and 3, the opposite is established in the display of FIG. 4. Here, the upper vertical position of the zero digit (26), combined with the left to right downwardly slanted blade segment of the hockey stick-shaped element (38), leads the viewer's scan of the display down toward the centrally located hour digits (30, 32), thus reinforcing the fact that the current time is decreasing relative to the approaching next hour. Also, the FIG. 4 display retains the intermediate position of the unit minute digit (28) between the tens of minute digits position to the left and the hour digits position to the right, in identical manner to all of the unit minutes displayed in the preceding twenty minutes of remaining time before the next hour. Thus, there is no back and forth shifting of time significance between the tens and unit minute positions, as occurred in the time pieces made in accordance with U.S. Pat. No. 4,627,737. Furthermore, the unit minute digit defining the significant time in minutes is located as close as possible to the oncoming tenth hour, thus portraying directional and progressional consistency with the closing minutes of the current hour, as well as positional and arithmetic consistency with all unit minutes displayed during the preceding twenty minute remaining time interval.

Figure 5:
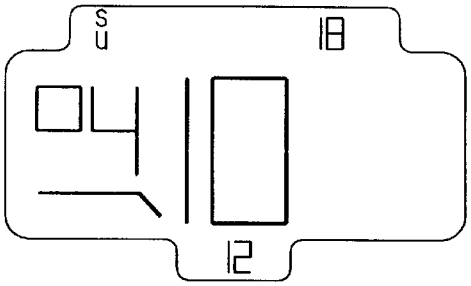
Figure 6:
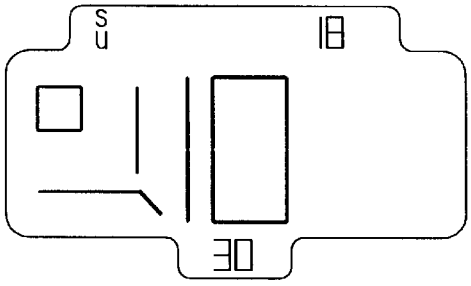

Referring next to FIGS. 5 and 6, there are illustrated further representative displays of time occurring during the last remaining ten minutes of the current ninth hour prior to the tenth hour. These displays have the same characteristics and provide like improved time significance and advantages as described in connection with FIG. 4.

Figure 1:
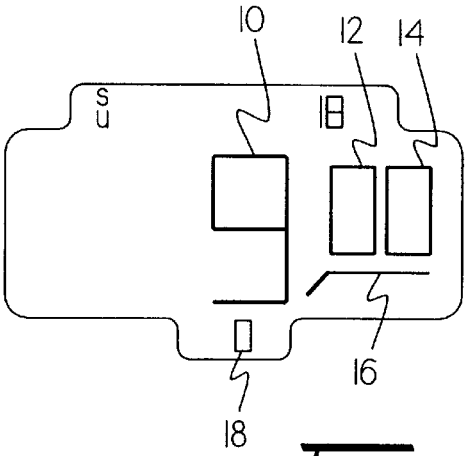
FIG. 1 is a view of digital display elements activated to display exactly 9 o'clock on a Sunday, the 18th of the month.

Additional reasons why the sequence of FIGS. 1–3 followed by FIGS. 4–6 may be preferred as optimal or best are the locations of the respective empty halves of the tens of minutes positions seen above and below the half-sized zero digits during those periods. During the initial ten-minute period (FIGS. 1–3), the empty space above the half-sized zero digit occupies the upper half of the tens of minutes position, which serves as a reminder that continuing advance of the time to the subsequent double-digit twenty-minute period will result in tens of minutes time values (digits one, two and three) to appear at full height to fill that space. Thus, the upper location of the half empty space during this period is a signal that more time information will grow into that space with continuation of the time in the first half hour.

In contrast, during the final ten-minute period before the next hour (FIGS. 4–6), the empty space in the lower half of the tens of minutes, located below the higher positioned half zero digit, gives the opposite impression. In particular, this display indicates that time is now progressing downwardly and diminishing to the ultimate point of no remaining minutes. Therefore, the lower positioned half empty space is a reminder that such emptiness will eventually expand to show no minute values before the arrival of the next hour. In these respects, the above-described sequence correlates the relative locations of both the half-sized zero digits and their associated half empty tens of minutes spaces to graphically portray the fact that time will be increasing during (and after) the initial ten-minute period and, conversely, time will be decreasing during the final ten minutes to the point of no remaining minutes before the next hour.

Figure 7:
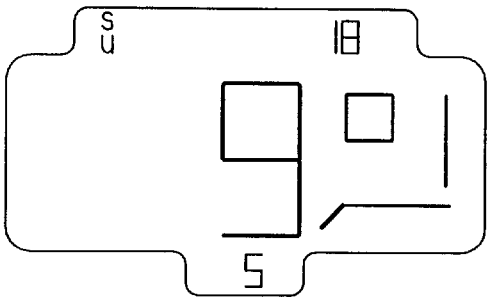
FIGS. 7–9 illustrate an alternative embodiment to FIGS. 2 and 3, also showing representative time displays during the first ten minutes of the ninth hour, in accordance with this invention.
Figure 8:
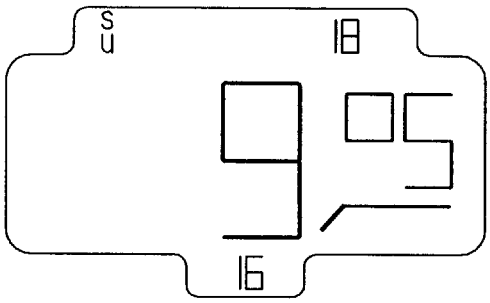
Figure 9:
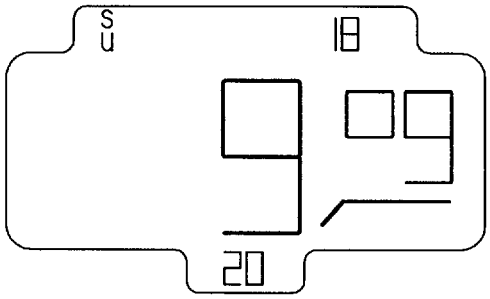

FIGS. 7–8 comprise an alternative embodiment to the displays illustrated in FIGS. 2 and 3. The difference is that the half-sized nonsignificant zero digits in FIGS. 7–8 are placed in the relatively upper vertical position horizontally aligned with the upper half of the adjacent elapsed unit minute digits, rather than in the relatively lower positions shown in FIGS. 2 and 3. This alternative has the advantage of establishing perfect horizontal symmetry with the appearance of the identically positioned remaining last nine minute digits on the left side of the hour, as exemplified in FIGS. 4 and 6. This symmetry uniformly communicates a visual message of incompleteness in the tens of minute position for both the initial and final nine minute intervals due to the same missing lower halves of the non-significant zero digits seen during those intervals. The resulting contrast between these appearances and the completely filled tens and unit minutes spaces with full height double digits during the intervening forty minute period of elapsed and remaining time intervals is analogous to the fact that the minute hand of a conventional analog time display is likewise located near the top of the dial during the initial elapsed and final remaining nine minute intervals. For these reasons, some viewers will prefer the alternative displays illustrated in FIGS. 1 and 4–9 as more desirable.

The invention has now been described in its operative principles and in terms of illustrative embodiments. The invention may be implemented with other variations which will be obvious to those skilled in the art. For example, with dot matrix displays, nonsignificant zero digits of sizes other than one-half the height of the minutes and in positions different from the lower and upper vertical positions shown in the illustrative embodiments may be used. Also, in multicolored displays the half-sized nonsignificant zero digits can be colored differently from all the other digits, for example, red versus black, to enhance their contrast in appearance and functionality from the significant minute digits.

Accordingly, it will be understood that the invention is not limited to the illustrative embodiments but also encompasses the subject matter delineated by the following claims and all equivalents thereof.

I claim:

1. In a balanced digital display which displays current hours with elapsed unit minute digits to the right thereof, next hours with remaining unit minute digits to the left thereof, with the current hours and the next hours substantially centrally on the display, the improvement which comprises nonsignificant zero digits displayed in the tens of minutes position between current hours and elapsed unit minutes during the initial nine minutes of a current hour, which nonsignificant zero digits are visually smaller in size than the size of the unit minute digits while the unit minute digits remain visually substantially the same in size.

2. The improvement according to claim 1 in which the nonsignificant zero digits are approximately half the height of the unit minute digits.

3. The improvement according to claim 2 in which the approximately half-sized zero digits are positioned horizontally adjacent to and aligned with the lower half of the unit minute digits.

4. The improvement according to claim 2 in which the approximately half-sized zero digits are positioned horizontally adjacent to and aligned with the upper half of the unit minute digits.

5. The improvement according to claim 1, 2, 3 or 4 in which a hockey stick-shaped element is displayed below the zero digits and the unit minute digits, with the blade segment of the element slanted upwardly from left to right to signify that the displayed minutes values are increasing.

6. In a balanced digital display which displays current hours with elapsed unit minute digits to the right thereof, next hours with remaining unit minute digits to the left thereof, with the current hours and the next hours substantially centrally on the display, the improvement which comprises nonsignificant zero digits displayed in the tens of minutes position to the left of remaining unit minute digits during the final nine minutes of a current hour approaching a next hour, which nonsignificant zero digits are visually smaller in size than the size of the unit minute digits while the unit minute digits remain visually substantially the same in size.

7. The improvement according to claim 6 in which the nonsignificant zero digits are approximately half the height of the unit minute digits.

8. The improvement according to claim 7 in which the approximately half-sized zero digits are positioned horizontally adjacent to and aligned with the upper half of the unit minute digits.

9. The improvement according to claim 6, 7 or 8 in which a hockey stick-shaped element is displayed below the zero digits and the unit minute digits, with the blade segment of the element slanted downwardly from left to right to signify that the displayed minute values are decreasing.

10. In a balanced digital display which displays current hours with elapsed unit minute digits to the right thereof, next hours with remaining unit minute digits to the left thereof, with the current hours and the next hours substantially centrally on the display, the improvement which comprises nonsignificant zero digits displayed in the tens of minutes position between current hours and elapsed unit minutes during the initial nine minute interval of a current hour, and nonsignificant zero digits displayed in the tens of minutes position to the left of remaining unit minute digits during the final nine minutes of a current hour approaching a next hour, which nonsignificant zero digits are visually smaller in size than the size of the unit minute digits during both of the nine minute intervals while the unit minute digits remain visually substantially the same in size.

11. The improvement according to claim 10 in which the nonsignificant zero digits are approximately half the height of the unit minute digits.

12. The improvement according to claim 11 in which during the initial nine minute interval, the approximately half-sized zero digits are positioned horizontally adjacent to and aligned with the lower half of the elapsed unit minute digits, and during the final nine minute interval, the nonsignificant zero digits are positioned horizontally adjacent to and aligned with the upper half of the remaining minute digits.

13. The improvement according to claim 10 in which during both the initial and final nine minute intervals, the nonsignificant zero digits are positioned horizontally adjacent to and aligned with the upper halves of both the elapsed and remaining unit minute digits.

14. The improvement according to claim 10, 11, 12 or 13 in which hockey stick-shaped elements are displayed below the zero digits and the elapsed and remaining unit minute digits during the initial and final nine minute intervals, with the blade segment of the hockey stick element slanted upwardly from left to right during the initial nine minute interval to signify that the displayed minute values are increasing, and with the blade segment of the hockey stick element slanted downwardly from left to right during the final nine minute interval to signify that the displayed minute values are decreasing.

15. In a balanced digital display which displays current hours with elapsed unit minute digits to the right thereof, next hours with remaining unit minute digits to the left thereof, with the current hours and the next hours substantially centrally on the display, the improvement which comprises displaying nonsignificant zero digits in the tens of minutes position between current hours and elapsed unit minutes during the initial nine minutes of a current hour, and displaying nonsignificant zero digits to the left of remaining minutes and next hours during the final nine minutes before a next hour, and maintaining the size of the nonsignificant zero digits visually smaller than the size of the unit minute digits while maintaining the size of the unit minute digits visually substantially the same, thereby achieving visual positional and arithmetical consistency of the unit minute digits relative to the tens of minute digits throughout the hour.

16. The improvement according to claim 15 in which the nonsignificant zero digits are approximately half the height of the unit minute digits.

17. The improvement according to claim 16 in which the approximately half-sized nonsignificant zero digits are maintained in a position horizontally adjacent to and aligned with the lower half of the elapsed unit minute digits.

18. The improvement according to claim 16 in which the approximately half-sized nonsignificant zero digits are maintained in a position horizontally adjacent to and aligned with the upper half of the remaining unit minute digits.

19. The improvement according to claim 16 in which the approximately half-sized nonsignificant zero digits are maintained in positions horizontally adjacent to and aligned with the upper halves of both the elapsed and the remaining unit minute digits.

20. The improvement according to claim 15, 16, 17, 18 or 19 which further includes displaying hockey stick-shaped elements below the nonsignificant zero digits and the elapsed and remaining unit minute digits, with the blade segment of the hockey stick element slanted upwardly from left to right during the initial elapsed nine minute interval of a current hour to signify that the displayed minute values are increasing, and with the blade segment of the hockey stock element slanted downwardly from left to right during the final remaining nine minute interval before a next hour to signify that the displayed minute intervals are decreasing.

* * * * *